US011731798B2

(12) United States Patent
Ping

(10) Patent No.: US 11,731,798 B2
(45) Date of Patent: Aug. 22, 2023

(54) HYBRID FLUID CARTRIDGE

(71) Applicant: Funai Electric Co., Ltd., Osaka (JP)

(72) Inventor: George Allan Ping, Lexington, KY (US)

(73) Assignee: Funai Electric Co., Ltd.

( * ) Notice: Subject to any disclaimer, the term of this patent is extended or adjusted under 35 U.S.C. 154(b) by 273 days.

(21) Appl. No.: 17/304,487

(22) Filed: Jun. 22, 2021

(65) Prior Publication Data

US 2022/0402645 A1 Dec. 22, 2022

(51) Int. Cl.

| | |
|---|---|
| ***B65D 1/48*** | (2006.01) |
| ***B65D 1/32*** | (2006.01) |
| *B41J 2/175* | (2006.01) |

(52) U.S. Cl.

CPC ..... *B65D 1/48* (2013.01); *B65D 1/32* (2013.01); *B41J 2/17503* (2013.01)

(58) Field of Classification Search

CPC .. B41J 2/17503; B41J 2/17513; B41J 2/1752; B41J 2/17523; B41J 2/1754; B41J 2/17553; B41J 2/17563; B65D 1/32; B65D 1/48

See application file for complete search history.

(56) References Cited

U.S. PATENT DOCUMENTS 5,138,344 A 8/1992 Ujita
5,640,186 A 6/1997 Swanson et al.
5,748,215 A 5/1998 Swanson et al.
5,767,881 A 6/1998 Geissmann
6,250,751 B1 6/2001 Whitney et al.
6,398,354 B1 6/2002 Lattuca et al.
6,460,984 B1 * 10/2002 Matsumoto ..... B41J 2/1752 347/86
6,502,926 B2 1/2003 Cook et al.
7,290,861 B2 * 11/2007 Inoue ..... B41J 2/1752 347/49
9,387,684 B2 7/2016 Ogawa et al.
2005/0270342 A1 12/2005 Ogura et al.
2008/0303880 A1 * 12/2008 Ujita ..... B41J 2/17536 347/86
2009/0066759 A1 3/2009 Mulay et al.
2011/0096121 A1 * 4/2011 Anderson, Jr. ..... B41J 2/17523 29/890.1

* cited by examiner

*Primary Examiner* — Anh T Vo

(74) *Attorney, Agent, or Firm* — Luedeka Neely Group, PC

(57) ABSTRACT

A fluid cartridge and a method for eliminating mechanical stresses on an ejection head chip. The fluid cartridge includes a plastic fluid body having a front wall, a rear wall opposite the front wall, left and right side walls attached to the front wall and to the rear wall, a bottom wall attached to the front wall and the rear wall, and to the left and right side walls. A die bond member is attached to the plastic fluid body adjacent to the bottom wall and an ejection head chip is disposed on the die bond member so that the die bond member is between the bottom wall and the ejection head chip.

14 Claims, 3 Drawing Sheets

HYBRID FLUID CARTRIDGE

TECHNICAL FIELD

The disclosure is directed to fluid supply cartridges for fluid ejection devices and in particular to hybrid fluid supply cartridges that provide improved dimensional stability for ejecting a variety of fluids.

BACKGROUND AND SUMMARY

A conventional fluid cartridge body is typically constructed of one or more plastic materials to which a semiconductor ejection head chip is directly attached by means of a die bond adhesive. Due to unequal expansion between the plastic cartridge body and the silicon semiconductor ejection head chip, misalignment and ejection head chip cracking may occur during manufacturing and use of the fluid cartridge. Thermal or mechanical stresses on the ejection head chip during die bonding and use may also result in distortion of the ejection head nozzles and bowing of the nozzle plate. While plastic fluid cartridges have been suitable for aqueous fluids as inks, the plastic fluid cartridges are not particularly useful for non-aqueous fluids such as solvents and organic liquids which may cause the plastic fluid cartridge body to swell. When the fluid ejection head is attached directly to the plastic fluid body, swelling of the cartridge body puts stresses on the ejection head causing ejection head cracking and nozzle plate distortion. Accordingly, what is needed is a dimensionally stable surface that has a coefficient of thermal or mechanical expansion similar to that of the semiconductor ejection head chip to which the ejection head chip is attached. What is also needed is an ejection head bonding surface that is chemically stable for use with fluids that cause plastic materials to swell.

In view of the foregoing, the disclosure provides a fluid cartridge that includes a plastic fluid body having a front wall, a rear wall opposite the front wall, left and right side walls attached to the front wall and to the rear wall, a bottom wall attached to the front wall and the rear wall, and to the left and right side walls. A die bond member is attached to the plastic fluid body adjacent to the bottom wall and an ejection head chip is disposed on the die bond member so that the die bond member is between the bottom wall and the ejection head chip.

In another embodiment, there is provided a method for eliminating mechanical stresses on an ejection head chip. The method includes providing a plastic fluid body having a front wall, a rear wall opposite the front wall, left and right side walls attached to the front wall and to the rear wall, a bottom wall attached to the front wall and the rear wall, and to the left and right side walls. A die bond member is attached to the plastic fluid body adjacent to the bottom wall. An ejection head chip is attached to the die bond member so that the die bond member is between the plastic fluid body and the ejection head chip, whereby mechanical stresses from the plastic fluid body are isolated from the ejection head chip.

In some embodiments, the die bond member further includes a filter tower riser, and the plastic fluid body further comprises a seal circumscribing the filter tower riser.

In some embodiments, the die bond member is a metal frame having a front arm adjacent to the front wall, a rear arm adjacent to the rear wall, and a bottom frame member attached to the front arm and to the rear arm, the bottom frame member being adjacent to the bottom wall, wherein the plastic body is press-fit into the metal frame.

In some embodiments, the metal frame includes a filter tower riser, and the plastic fluid body further includes a seal circumscribing the filter tower riser.

In some embodiments, the seal is an o-ring seal disposed in a recess in the plastic fluid body.

In some embodiments, the plastic body contains a retention tab on each of the front wall and the rear wall, and the metal frame has a retention aperture disposed in each of the front arm and rear arm of the metal frame for engaging the front wall retention tab and the rear wall retention tab.

In some embodiments, the die bond member further includes a chip pocket for attaching the ejection head chip therein.

In some embodiments, the die bond member is a metal selected from the group consisting of stainless steel, aluminum, titanium, and alloys of steel and titanium.

In some embodiments, the die bond member is a chemically resistant carbon filled, carbon fiber filled, or glass fiber filled polymeric material selected from polyamides, polybutylene terephthalate, polycarbonate, polyethylene, polyphenyleneoxide, polyphenylenesulfide, and polytetrafluoroethylene.

DETAILED DESCRIPTION OF THE DISCLOSED EMBODIMENTS

Figure 1:
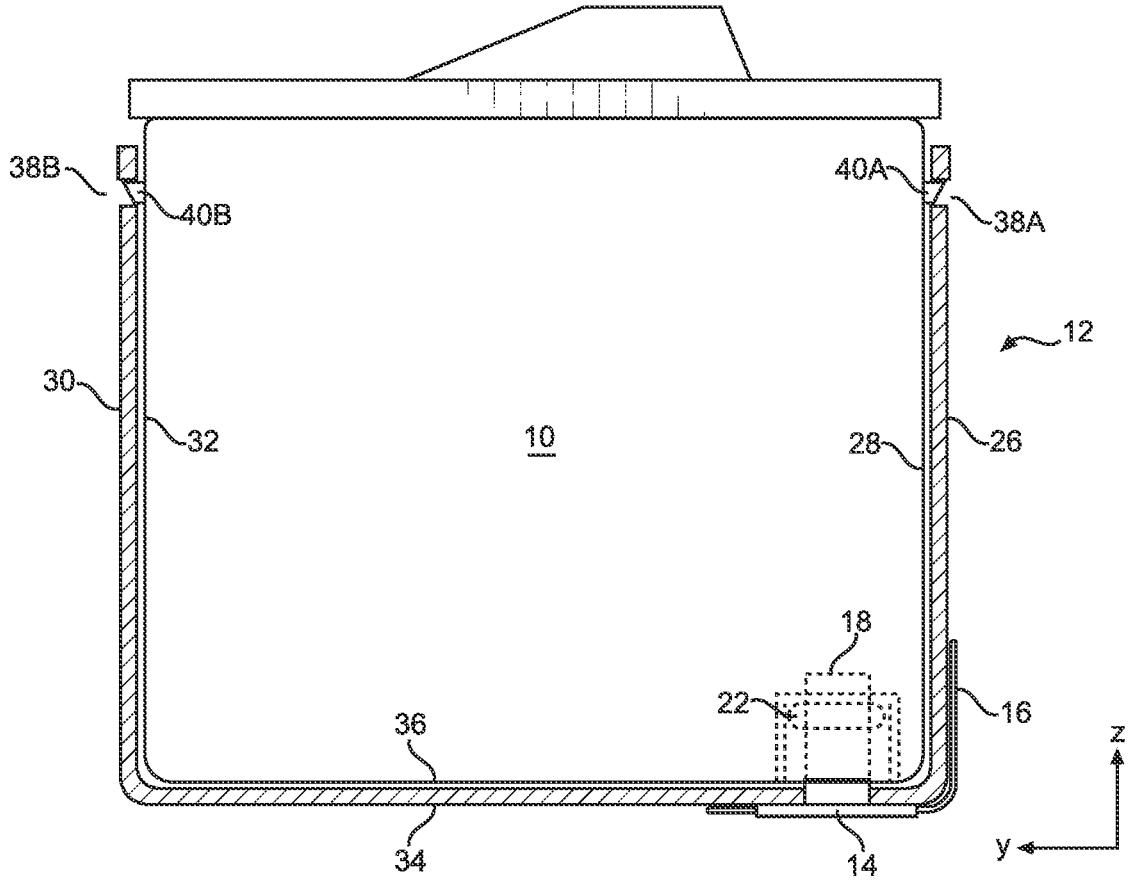
FIG. 1 is a side elevational view, not to scale, of a fluid cartridge body and a die bond member to which a fluid ejection head and flexible circuit are attached.
Figure 2:
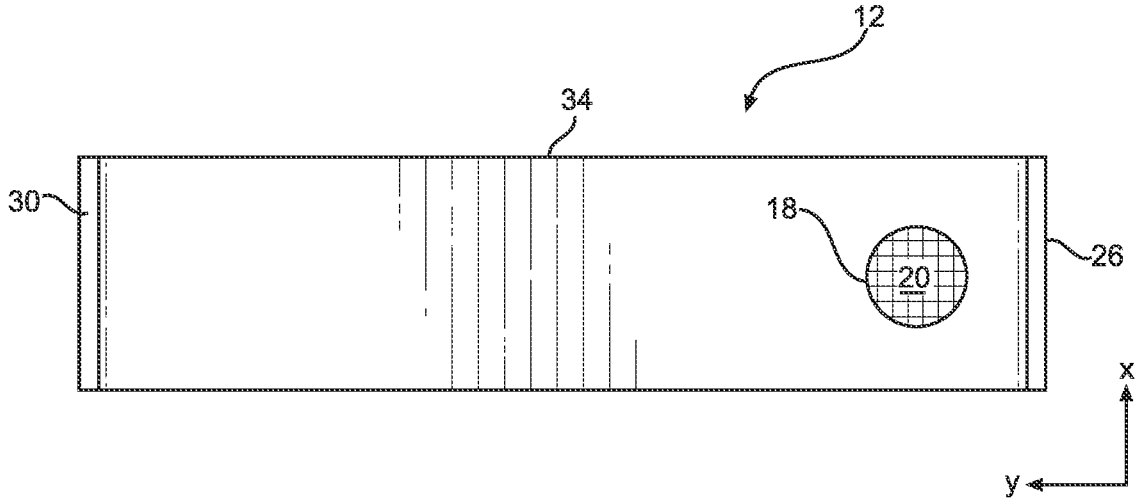
FIG. 2 is a top plan view, not to scale, of the die bond member according to an embodiment of the disclosure.
Figure 3:
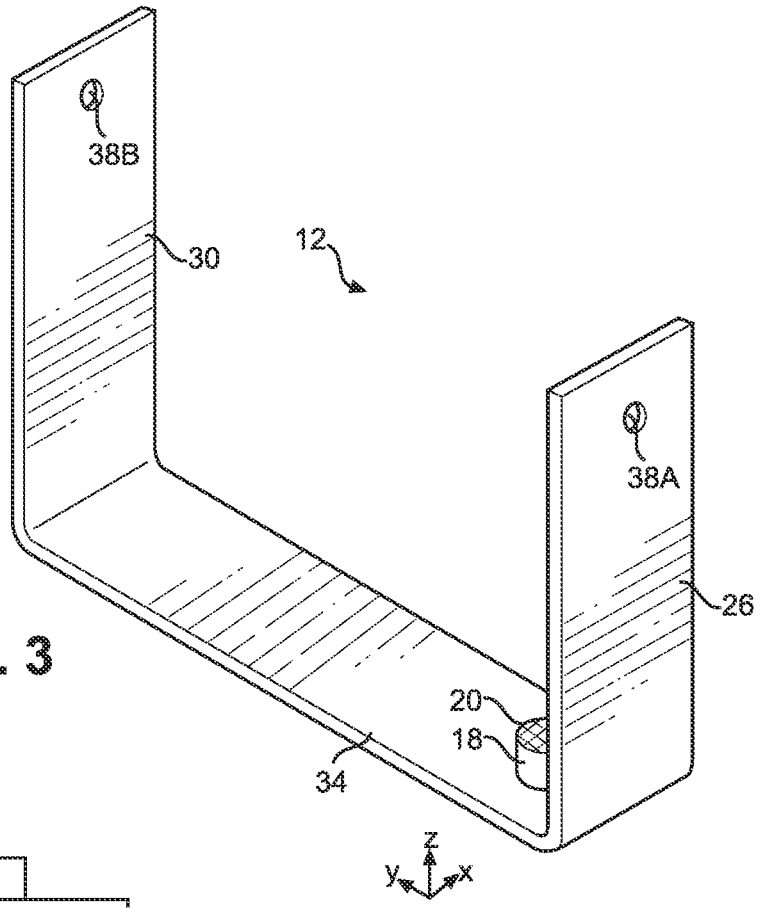
FIG. 3 is a perspective view, not to scale, of the die bond member of FIG. 2.
Figure 4:
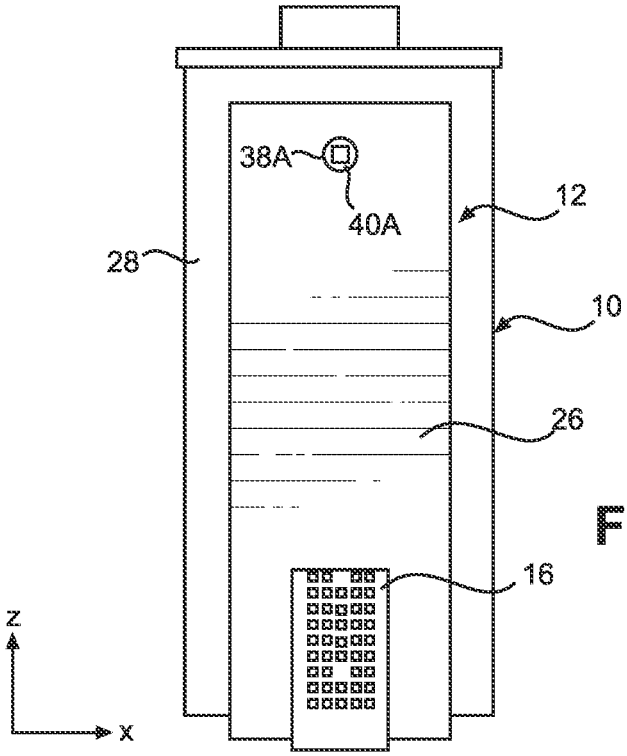
FIG. 4 is a front elevational view, not to scale, of the fluid cartridge body and the die bond member of FIG. 1.
Figure 5:
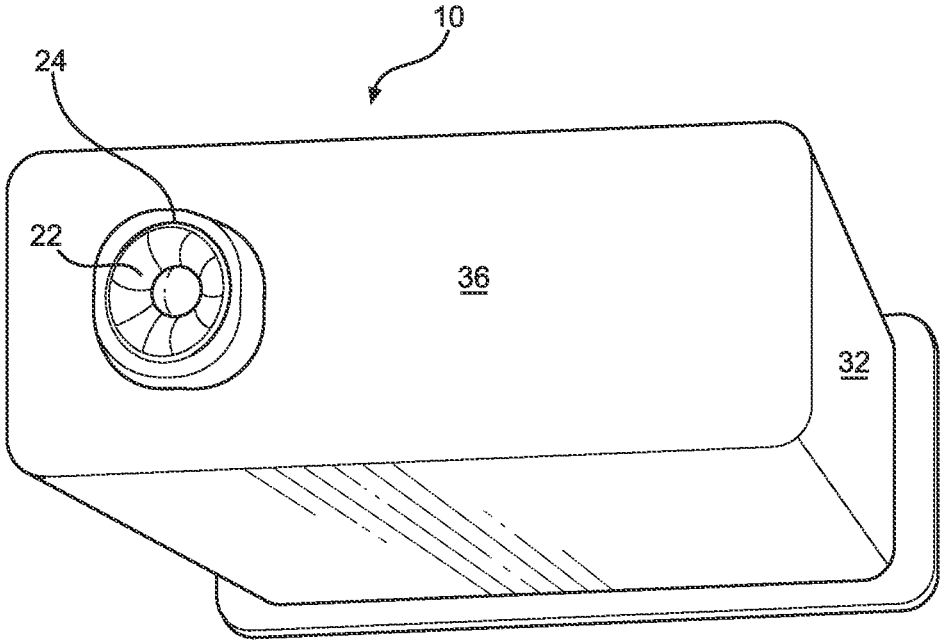
FIG. 5 is a bottom perspective view, not to scale, of a plastic fluid cartridge body for use with the die bond member according to an embodiment of the disclosure.

With reference to FIGS. 1-5, there is shown a plastic fluid cartridge body 10 and a die bond member 12 according to an embodiment of the disclosure. An ejection head 14, described in more detail below, is attached to the die bond member 12 and flexible tab circuit 16 is attached to the ejection head 14 and to the die bond member 12. The die bond member 12 also includes a filter tower 18 containing a filter 20 for providing filtered fluid from an interior of the cartridge body 10 to the ejection head 14. The filter tower 18 may be a cylindrical structure that is press-fit into a hole in the die bond member 12 or laser seal-welded to the die bond member. A seal such as an o-ring seal 22 provides a hermetic fluid seal between the filter tower 18 and the cartridge body 10. FIG. 5 is a perspective view of the bottom wall 34 of the cartridge body 10 illustrating a recessed area 24 into which the o-ring seal is inserted.

In some embodiments, as shown in FIGS. 1-4, the die bond member 12 is a stamped frame that includes a front arm 26 adjacent to a front wall 28 of the cartridge body 10, a rear arm 30 adjacent to a rear wall 32 of the cartridge body 10, and a bottom frame member 34 attached to the front arm 26 and to the rear arm 30. The bottom frame member 34 is adjacent to the bottom wall 36 of the cartridge body 10. In some embodiments, the cartridge body 10 is press-fit into the stamped frame of the die bond member 12.

In some embodiments, the die bond member 12 in the shape of a stamped U-shaped frame includes apertures 38*a* and 38*b* in the front arm 26 and rear arm 30, respectively, for engaging retention tabs 40*a* and 40*b*, respectively, on the plastic cartridge body 10. The retention tabs 40*a* and 40*b* and apertures 38*a* and 38*b* provide locking engagement between the frame of the die bond member 12 and the cartridge body 10 to prevent disengagement of the cartridge body 10 from the die bond member 12.

When the die bond member 12 includes a stamped metal U-shaped frame, the stamped metal frame may be made of a metal selected from stainless steel, aluminum, titanium, and alloys of steel and titanium. The metal frame may have a thickness ranging from about 1 to about 2 mm and a bend radius of about 1.5 to about 1.65 mm between the front arm 26 and rear arm 30 with the bottom frame member 34 to provide positive engagement of the apertures 38*a* and 38*b* in the arms 26 and 30 with the retention tabs 40*a* and 40*b* on the cartridge body 10.

In some embodiments, the die bond member made be made of a chemically resistant polymeric material that is reinforced with carbon, carbon fibers or glass fibers. Suitable carbon filled, carbon fiber filled, or glass fiber filled polymeric materials may be selected from, but not limited to, polyamides, polybutylene terephthalate, polycarbonate, polyethylene, polyphenyleneoxide, polyphenylenesulfide, and polytetrafluoroethylene.

Having the ejection head 14 attached directly to the die bond member 12 rather than to the plastic cartridge body 10 provides a mechanically stable surface for the ejection head 14 so that swelling or distortion of the plastic cartridge body 10 is isolated from the ejection head 14. In some embodiments, when using a metal die bond member, the die bond member 14 may also provide a heat sink for cooling the ejection head 14 during fluid ejection.

Figure 6:
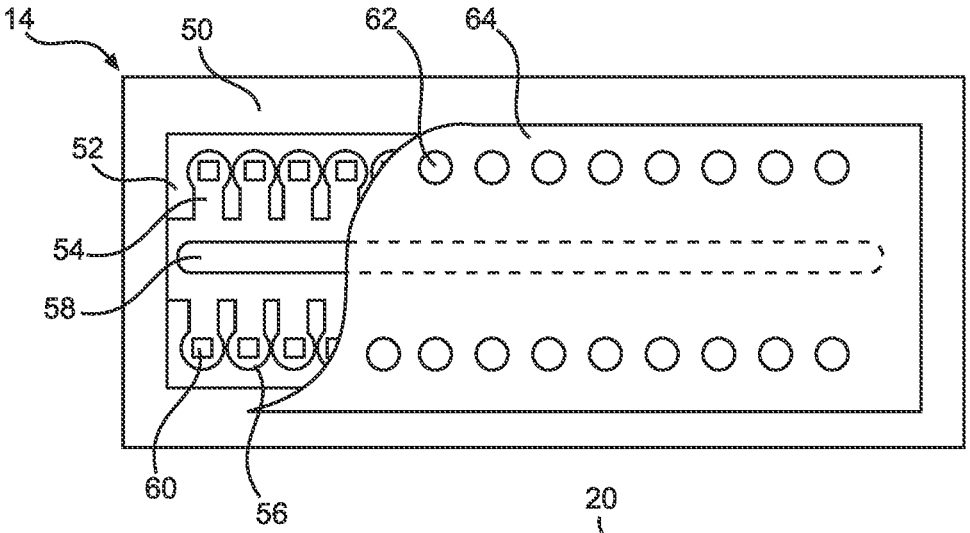
FIG. 6 is a plan view, not to scale, of an ejection head chip for the fluid cartridge body and the die bond member according to an embodiment of the disclosure.

A conventional ejection head 14 is illustrated in FIG. 6 and includes a silicon semiconductor substrate 50 that includes a flow feature layer 52 made from a photoresist material having fluid channels 54 and fluid chambers 56 photoimaged therein. A fluid supply via 58 is etched through the semiconductor substrate 50 and provides fluid to the fluid channels 54 and fluid chambers 56. Each of the fluid chambers 56 includes a fluid ejection device 60 that may be selected from a resistor heater or a piezoelectric device for ejection fluid from the fluid chambers 56 through associated nozzle holes 62 in a nozzle plate 64 attached to the flow feature layer 52. A die bond adhesive is used to attach the ejection head 14 to the die bond member 12. Electrical connections from the flexible tab circuit 16 to the ejection head 14 are insulated from the die bond member by conventional die bond adhesives and encapsulate materials. The flexible tab circuit 16 also includes a dielectric layer that insulates tabs on the tab circuit 16 from the die bond member 12.

Figure 7:
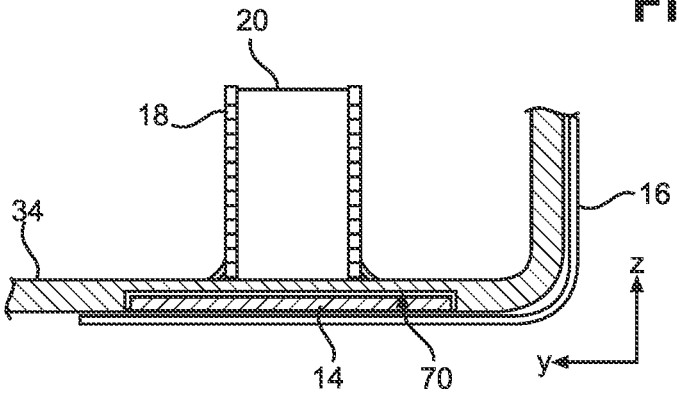
FIG. 7 is a partial, cross sectional view of a portion of the die bond member according to an embodiment of the disclosure.

In some embodiments, as shown in FIG. 7, a chip pocket 70 may be molded, stamped, or machined into the bottom frame member 34 of the die bond member 12 for die bonding the ejection head 14 thereto. In other embodiments, the ejection head 14 is merely attached to the bottom frame member 34 in the absence of the chip pocket 70. However, a chip pocket 70 may be useful for assuring proper alignment and location of the ejection head 14 on the bottom frame member 34.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fluid cartridge comprising:

a plastic fluid body having a front wall, a rear wall opposite the front wall, left and right side walls attached to the front wall and to the rear wall, a bottom wall attached to the front wall and the rear wall, and to the left and right side walls;

a die bond member attached to the plastic fluid body adjacent to the bottom wall; and an ejection head chip disposed on the die bond member, wherein the die bond member is between the bottom wall and the ejection head chip, and wherein the die bond member comprises a metal selected from the group consisting of stainless steel, aluminum, titanium, and alloys of steel and titanium.

2. The fluid cartridge of claim 1, wherein the die bond member further comprises a filter tower riser, and the plastic fluid body further comprises a seal circumscribing the filter tower riser.

3. The fluid cartridge of claim 2, wherein the seal comprises an o-ring seal disposed in a recess in the plastic fluid body.

4. The fluid cartridge of claim 1, wherein the die bond member comprises a frame having a front arm adjacent to the front wall, a rear arm adjacent to the rear wall, and a bottom frame member attached to the front arm and to the rear arm, the bottom frame member being adjacent to the bottom wall, wherein the plastic body is press-fit into the frame.

5. The fluid cartridge of claim 4, wherein the frame further comprises a filter tower riser, and the plastic fluid body further comprises a seal circumscribing the filter tower riser.

6. The fluid cartridge of claim 4, wherein the plastic body comprises a retention tab on each of the front wall and the rear wall, and the frame comprises a retention aperture disposed in each of the front arm and rear arm of the frame for engaging the front wall retention tab and the rear wall retention tab.

7. The fluid cartridge of claim 1, wherein the die bond member further comprises a chip pocket for attaching the ejection head chip therein.

8. A method for eliminating mechanical stresses on an ejection head chip comprising:

providing a plastic fluid body having a front wall, a rear wall opposite the front wall, left and right side walls attached to the front wall and to the rear wall, a bottom wall attached to the front wall and the rear wall, and to the left and right side walls;

attaching a die bond member to the plastic fluid body adjacent to the bottom wall; and attaching an ejection head chip to the die bond member so that the die bond member is between the plastic fluid body and the ejection head chip, whereby mechanical stresses from the plastic fluid body are isolated from the ejection head chip, wherein the die bond member comprises a metal selected from the group consisting of stainless steel, aluminum, titanium, and alloys of steel and titanium.

9. The method of claim 8, wherein the die bond member comprises a filter tower riser, and the plastic fluid body comprises a sealing member circumscribing the filter tower riser, further comprising sealing the filter tower riser to the plastic fluid body via the sealing member.

10. The method of claim 9, wherein the sealing member comprises an o-ring seal further comprising disposing the o-ring seal in a recess in the plastic fluid body.

11. The method of claim 8, wherein the die bond member comprises a frame having a front arm for attachment adjacent to the front wall, a rear arm for attachment adjacent to the rear wall, and a bottom frame member attached to the front arm and to the rear arm for attachment adjacent to the bottom wall, further comprising press-fitting the plastic fluid body into the frame.

12. The method of claim 11, wherein the frame comprises a filter tower riser, and the plastic fluid body comprises a sealing member circumscribing the filter tower riser, further comprising sealing the filter tower riser to the plastic fluid body via the sealing member.

13. The method of claim 11, wherein the plastic body comprises a retention tab on each of the front wall and the rear wall, and the frame comprises a retention aperture disposed in each of the front arm and rear arm of the frame, further comprising engaging the front wall retention tab and the rear wall retention tab with the retention aperture on each of the front arm and rear arm of the frame.

14. The method of claim 8, wherein the metal die bond member comprises a chip pocket, further comprising attaching the ejection head chip in the chip pocket of the die bond member.

* * * * *